United States Patent [19]

MacDonald

[11] 4,375,901

[45] Mar. 8, 1983

[54] BEACH CHAIR

[75] Inventor: Christopher MacDonald, Costa Mesa, Calif.

[73] Assignee: Designs Five, Inc., Costa Mesa, Calif.

[21] Appl. No.: 223,895

[22] Filed: Jan. 9, 1981

[51] Int. Cl.[3] ..... A47C 21/00

[52] U.S. Cl. ..... 297/377; 5/419; 297/183; 297/391

[58] Field of Search ..... 297/396, 391, 377, 183; 5/439, 437, 440, 419, 417, 418; 248/156, 530

[56] References Cited

U.S. PATENT DOCUMENTS

| | | | |
|---|---|---|---|
| 272,273 | 2/1883 | Leavitt, Jr. | 297/377 |
| 295,971 | 4/1884 | Bakewell | 297/377 |
| 405,038 | 6/1889 | Koechling | 297/377 |
| 486,275 | 11/1892 | Butler | 297/377 |
| 1,660,494 | 2/1928 | Robertson | 297/377 |
| 1,842,424 | 1/1932 | Ponten et al. | 297/377 |
| 2,109,881 | 3/1938 | Goldberg | 5/418 |
| 2,304,700 | 12/1942 | Manville | 5/419 X |
| 2,429,795 | 10/1947 | Blanchard et al. | 297/396 |
| 2,480,196 | 8/1949 | Poyer | 5/419 |
| 2,571,282 | 10/1951 | Newton et al. | 297/183 X |
| 2,713,890 | 7/1955 | Mack | 297/31 |
| 2,884,991 | 5/1959 | Bloomquist | 5/419 X |
| 3,822,424 | 7/1974 | Messer | 5/344 |
| 4,190,290 | 2/1980 | Strien | 297/408 |
| 4,194,601 | 3/1980 | Yellin | 5/417 X |

*Primary Examiner*—James T. McCall

*Attorney, Agent, or Firm*—Fulwider, Patton, Rieber, Lee & Utecht

[57] ABSTRACT

A beach chair including an integral tubular frame having a top run joined on its opposite extremities with downwardly projecting side legs which terminate at their lower extremities in stakes for being driven into the beach. A tubular headrest is telescoped onto the top run and the upper extremity of a strut projects laterally through such headrest and is rotatably connected with such top run for pivoting from a collapsed position disposed in the general plane of the side legs to a supporting position angled outwardly and rearwardly from such side legs. A web is stretched between the side legs and, if desirable, an apron or flap may project from the lower extremity thereof to serve as a cover over an underlying seating area.

8 Claims, 13 Drawing Figures

FIG. 1
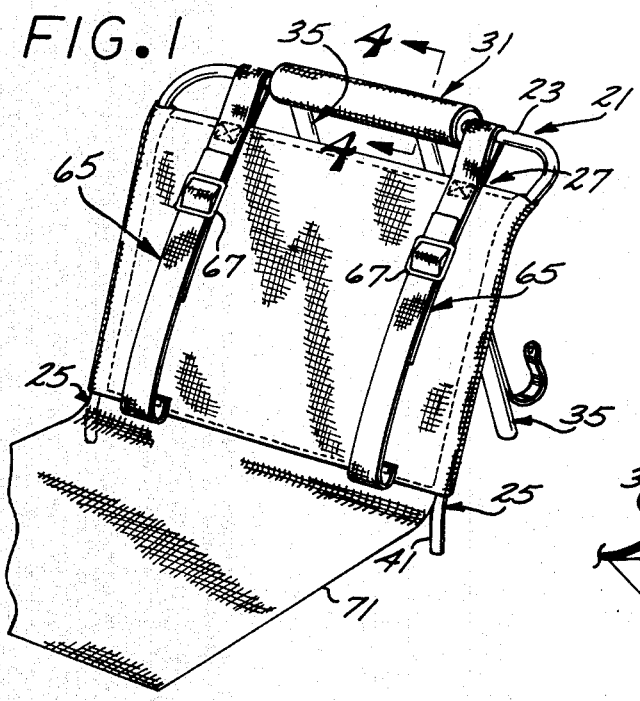
FIG. 2
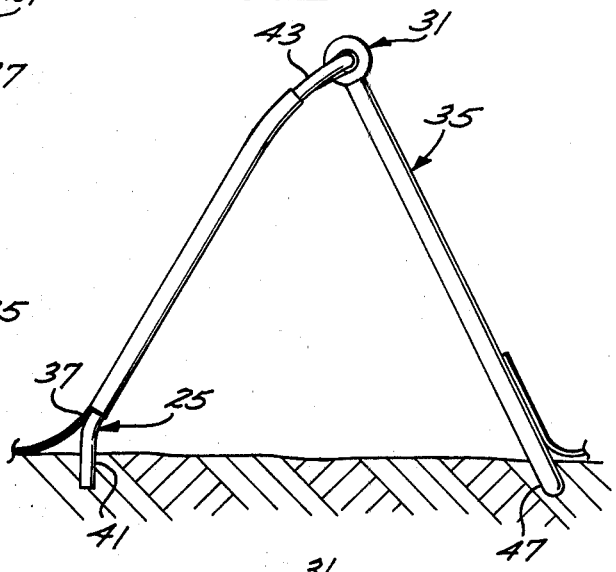
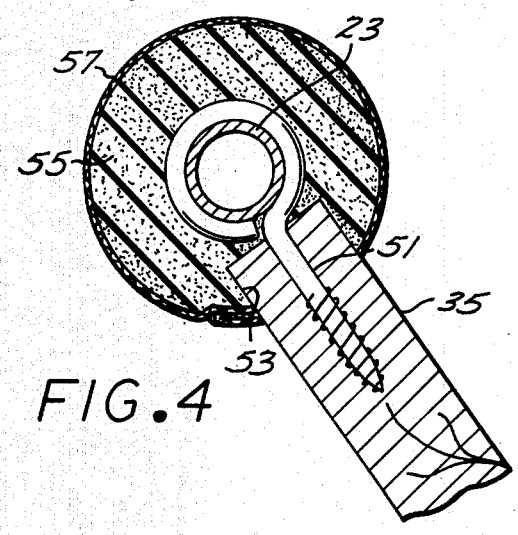
FIG. 4
FIG. 3
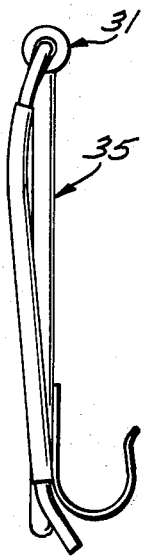
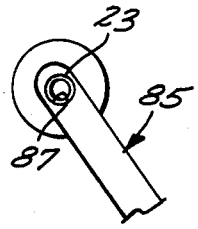
FIG. 5
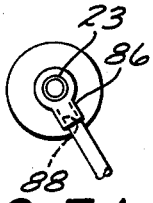
FIG. 5A
FIG. 6
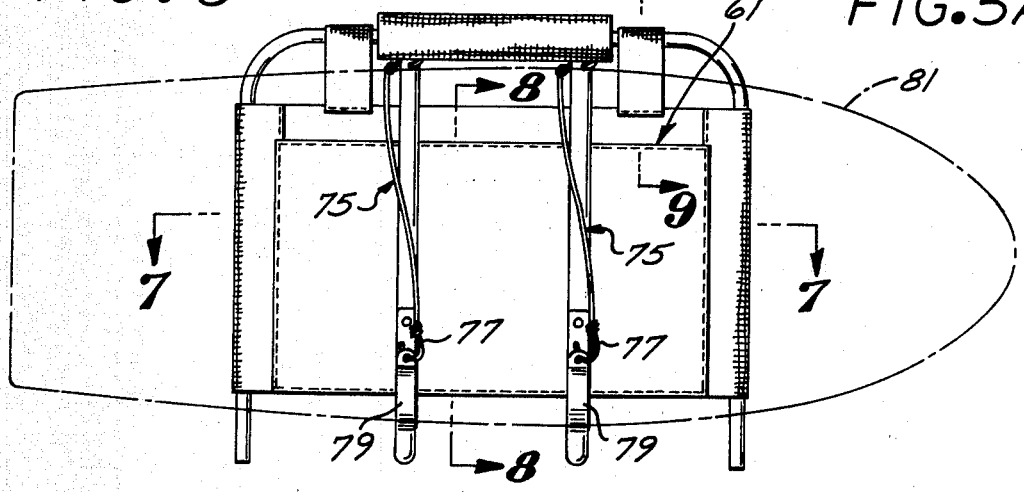

FIG. 7
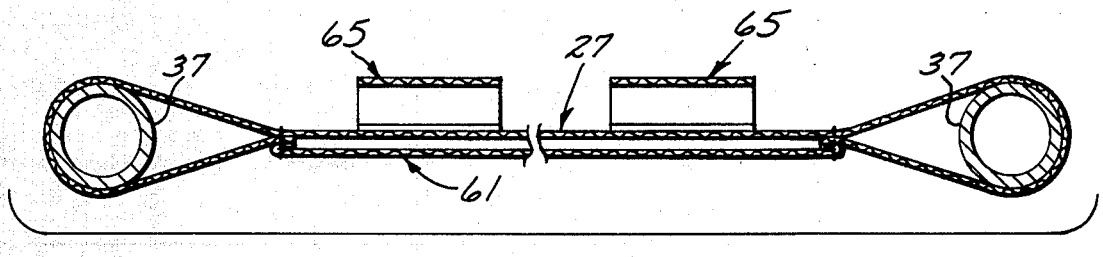
FIG. 8
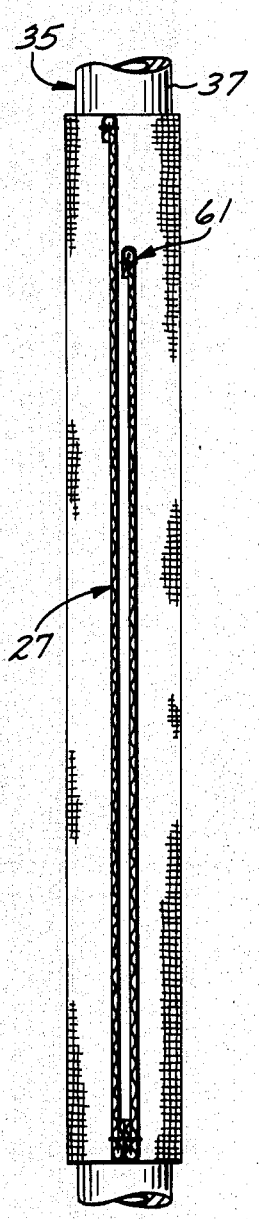
FIG. 9
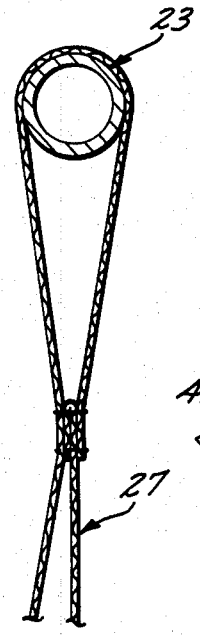
FIG. 10
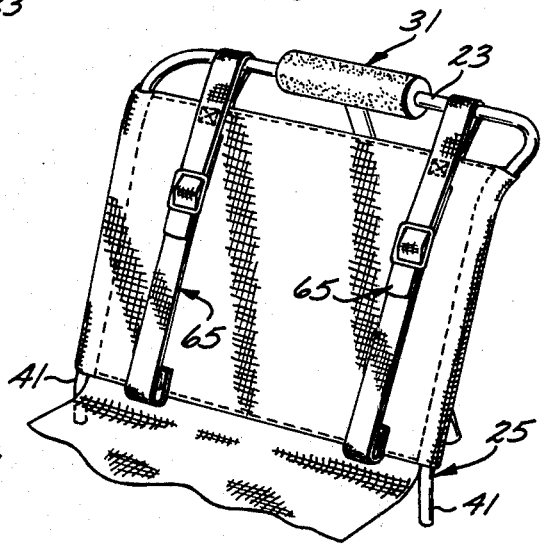
FIG. 11
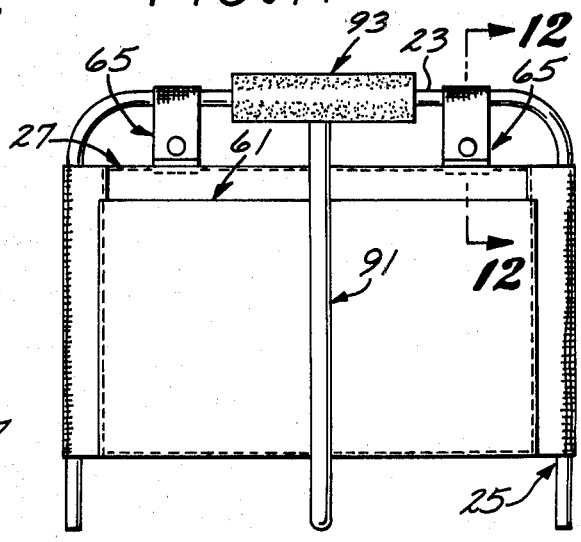
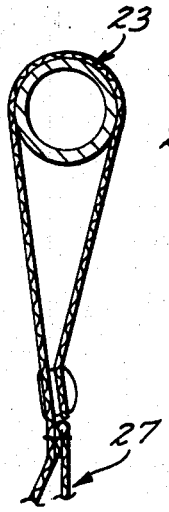
FIG. 12

BEACH CHAIR

BACKGROUND OF THE INVENTION

1. Field of the Invention

The present invention relates generally to collapsible chairs and, more particularly, to chairs to be used at the beach.

2. Description of the Prior Art

It is known to provide collapsible beach chairs which are formed of a frame type construction having the lower extremities of the side legs thereof in the form of stakes. However, there is no prior art beach chairs known to applicant which incorporate a headrest pillow telescoped over the top run of the frame and have a strut also rotatably connected to such top run for angling downwardly and rearwardly therefrom and formed at its lower extremity with a stake.

SUMMARY OF THE INVENTION

The collapsible beach chair of the present invention is characterized by a generally rectangular frame open on its bottom side and formed at the lower extremity of the side legs with stakes. A tubular headrest is telescoped over the top run and has a strut projecting laterally therethrough and rotatably connected on one end with such top run.

Additional features of the present invention include the provision of a pair of struts rotatably mounted on their respective one extremities from the top run and having mounted on their back sides, brackets for receipt of paraphernalia to be elevated from the beach, such as surf boards and the like. Additionally, the beach chair may incorporate shoulder straps for convenient carrying thereof from the shoulders of a user and may be formed with auxiliary pockets for receipt of sunbathing material.

These and other features of the invention will become apparent from a consideration of the following detailed description of the drawings.

DESCRIPTION OF THE DRAWINGS

FIG. 1 is a perspective view of a beach chair embodying the present invention;

FIG. 2 is a left hand side view of the beach chair shown in FIG. 1;

FIG. 3 is a side view similar to FIG. 2, but showing the beach chair collapsed;

FIG. 4 is a sectional view, in enlarged scale, taken along the lines 4—4 of FIG. 1;

FIG. 5 is a partial side view similar to FIG. 3, but showing a second embodiment of the beach chair of the present invention;

FIG. 5A is a partial sectional view similar to FIG. 5, and showing a third embodiment of the beach chair of the present invention;

FIG. 6 is a back view of the beach chair shown in FIG. 1;

FIG. 7 is a transverse sectional view, in enlarged scale, taken along the lines 7—7 of FIG. 6;

FIG. 8 is a vertical sectional view, in enlarged scale, taken along the lines 8—8 of FIG. 6;

FIG. 9 is a partial vertical sectional view, in enlarged scale, taken along the lines 9—9 of FIG. 6;

FIG. 10 is a perspective view of a fourth embodiment of the beach chair of present invention;

FIG. 11 is a back view of the beach chair shown in FIG. 10; and,

FIG. 12 is a partial vertical sectional view, in enlarged scale, taken along the lines 12—12 of FIG. 11.

DESCRIPTION OF THE PREFERRED EMBODIMENTS

Referring to FIG. 1, the beach chair of the present invention includes, generally, a unitary tubular frame 21 of generally rectangular shape to form a top run 23 having downwardly projecting legs 25 joined with the opposite ends thereof. Stretched between such side legs 25 is a back webbing, generally designated 27. Telescoped over the top run 23 is a tubular headrest pillow, generally designated 31. Pivotally connected to the top run 23 and projecting laterally through the headrest pillow 31 are a pair of struts, generally designated 35. Thus, the struts 35 may be rotated to a collapsed position as shown in FIG. 3 for easy portage of the chair itself and when the destination is reached, such struts may be pivoted outwardly to an inclined position of the desired angle and staked in the beach as shown in FIG. 2 and a user may then vest his back against the webbing 27 and his head against the headrest pillow 31.

Referring to FIG. 2, the side legs 25 are formed with a straight intermediate length 37 and then bend away at an angle to form stakes 41 on their bottom extremities. Similarly, the side legs 25 also bend away at their upper extremities to form turned back lengths 43 which serve to position the headrest 31 in a comfortable orientation with respect to the backrest webbing 27 and to position the pivot point of the struts 35 out of the plane of the intermediate runs 37 for convenient and full collapse of the struts as shown in FIG. 3. Likewise, the angled stakes 41 and turned back lengths 43 serve to resist upward and downward shifting of the backrest webbing 27 once such webbing is placed in position on the intermediate length 37.

The struts 35 may be constructed of, for instance wood, and formed at their bottom extremities stakes 47 which may be driven into the beach and are joined at their upper extremities to the top run 23 by means of, for instance, an eyebolt 51. The stakes 35 themselves project into lateral bores 53 formed in the headrest 31 as shown in FIG. 4. Consequently, the eyebolt 51 provides for both rotation about the axis of the top run 23 as well as for a limited amount of swiveling with respect to the axis of such top run.

The headrest 31 is constructed of tubular, opencore foam material 55 (FIG. 4) which is covered by means of a vinyl cover 57 or other desirable material. The struts project radially outwardly through bores 33 formed in the cylindrically shaped headrest to cause such headrest to rotate therewith.

Referring to FIG. 6, the backrest webbing 27 may be formed with a upwardly opening pocket, generally designated 61 and clearly shown in FIG. 8.

Referring to FIGS. 1 and 6, a pair of shoulder straps, generally designated 65, are looped on their respective on extremities over the top run 23 and are sewn on their bottom extremities to the bottom extremity of the back webbing 27. The intermediate portion of the shoulder straps 65 are joined by means of adjustment buckles 67.

In the preferred embodiment, an apron 71 is joined with the bottom extremity of the back webbing 27 for projection from the chair to serve as a seating area for a user.

Referring to FIG. 6, a pair of elastic bungie cords, generally designated 75, are connected on their respective upper extremities with the top portion of the stakes 35 and are connected on their opposite extremities with respective hooks 75 which may be hooked into the extending extremity of hook shaped brackets 79 mounted on the backs of the respective struts 35.

In use, the struts 35 are normally collapsed to the position shown in FIG. 3, it being appreciated that the bores 33 in the headrest 57 serve to maintain such struts in their laterally spaced apart position shown in FIG. 6. Likewise, the tubular foam 55 is compressed slightly radially inwardly against the top run 23 by the cover 57 (FIG. 4) to maintain such headrest, and consequently the struts 35, frictionally in their centrally located position along the length of the top run 23.

The user may conveniently carry the chair to a beach location by placing the shoulder strap 65 over his shoulders thus extending his arms laterally outwardly to the opposite sides of such straps. When the desired beach area is reached, the beach chair is removed from the user's shoulders and the struts 35 pivoted outwardly away from the main frame and the stakes 41 driven or pressed into the beach sand. The struts 35 are pivoted outwardly to the angle desired by the user for resting his back against the backrest web 27 with the desired degree of recline. The strut stakes 47 are then driven or pressed into the beach sand. The user may then position himself on the apron 71 and rest his back against the webbing 27 with his head rested backwardly against the headrest cushion 31.

Should the user be a surfer, he may conveniently position his surf board 81 (FIG. 6) in the upwardly opening brackets 79 and such surf board may be secured in place by means of the bungie cords 75. Obviously, when the user elects to leave the beach area, the chair may be rapidly withdrawn from its staked position, collapsed and again placed on the back of the user for transport back to his car or place of storage.

Referring to FIG. 5, the second embodiment of the beach chair of the present invention includes a strut, generally designated 85, which is formed on its upper extremity with a transverse bore 87 for telescopical receipt over the top run 23 of the chair frame. This arrangement may be preferred by some over the eyebolt attachment 51 shown in FIG. 4.

The detail of the beach chair shown in FIG. 5A is similar to that shown in FIG. 5, except that it incorporates a Tee member 86 having its run journaled on the top run 23 and having its leg formed with a bore 88 into which the top end of a strut 90 is pressed fit. This arrangement may be preferred for certain applications of the present invention.

Referring to FIG. 10, the fourth embodiment of the beach chair of present invention is generally similar to that shown in FIG. 1, except that only a single strut, generally designated 91, is rotatably connected on its upper extremity to the top run 23 of the chair frame and projects through a lateral opening formed centrally in the headrest, generally designated 93 and constructed similar to the headrest 31. Usage of the beach chair shown in FIG. 11 is similar to that of the beach chair shown in FIG. 1, except that there is only the necessity of staking the single strut.

From the foregoing, it will be apparent that the collapsible beach chair of the present invention provides an economical and convenient means for supporting a user at any desired inclination of recline at the beach and will support both the user's back and head without the necessity of placing a cushion, pillow or folded towel on the chair frame for comfortable support.

I claim:

1. A chair for use on a beach comprising:

a generally rectangular open bottom frame formed with a horizontal top run joined at its opposite extremities with oppositely disposed side legs projecting downwardly and defining at each of their lower extremities respective side stakes, said side stakes particularly characterized by an inclination of said side stakes with respect to said corresponding side legs so that when said beach chair is set up on said beach with said side legs inclined, said side stakes are generally vertical, thereby maximizing the holding power of said side stakes;

a strut rotatably connected on one extremity with said top run for rotating thereabout from a collapsed position in the plane of said side legs to support position angled outwardly therefrom and defining on its bottom extremity a strut stake;

web means connected on its opposite ends with said side legs to form a back rest; and, a generally tubular headrest cushion telescoped over said top run whereby said strut may be rotated to said support position and said strut stake driven into the beach so a user may rest his back against said web means and his head against said headrest cushion.

2. A beach chair comprising:

a generally rectangular open bottom frame formed with a horizontal top run joined at its opposite extremities with oppositely disposed side legs projecting downwardly and defining at their lower extremities respective side stakes, said side legs are formed with substantially straight intermediate lengths and then bent to project said side stakes at an angle thereto;

a strut rotatably connected on one extremity with said top run for rotating thereabout from a collapsed position in the plane of said side legs to support position angled outwardly therefrom and defining on its bottom extremity a strut stake;

web means connected on its opposite ends with said side legs to form a backrest; and, a generally tubular headrest cushion telescoped over said top run whereby said strut may be rotated to said support position and said opposite extremities of said webbing are wrapped around said intermediate lengths to cause said side stakes to resist free telescoping of said webbing from said intermediate lengths.

3. A beach chair comprising:

a generally rectangular open bottom frame formed with horizontal top run joined at its opposite extremities with oppositely disposed side legs projecting downwardly and defining at their lower extremities respective side stakes;

a strut rotatably connected on one extremity with said top run for rotating thereabout from a collapsed position in the plane of said side legs to support position angled outwardly therefrom and defining on its bottom extremity, a strut stake;

web means connected on its opposite ends with said side legs to form a backrest;

a generally tubular headrest cushion telescoped over said top run whereby said strut may be rotated to said support position and said strut stake driven into the beach so a user may rest his back against said web means and his head against said headrest cushion; and a pair of shoulder straps connected on their respective one ends with said top run and on their respective opposite ends with the bottom of said webbing.

4. A beach chair comprising:

a generally rectangular open bottom frame formed with a horizontal top run joined at its opposite extremities with oppositely disposed side legs projecting downwardly and defining at their lower extremities respective side stakes;

a strut rotatably connected on one extremity with said top run for rotating thereabout from a collapsed position in the plane of said side legs to support position angled outwardly therefrom and defining on its bottom extremity a strut stake;

web means connected on its opposite ends with said side legs to form a back rest; and, a generally tubular headrest cushion telescoped over said top run whereby said strut may be rotated to said support position and said strut stake driven into the beach so a user may rest his back against said web means and his head against said headrest cushion, said headrest cushion being formed with a laterally projecting opening through which said strut passes to cause said headrest to rotate with said strut and is further formed to closely fit on said top run to frictionally resist longitudinal shifting thereof on said top run.

5. A beach chair as set forth in claim 2 wherein:

said side legs are formed at the top ends of said side lengths with turned back lengths.

6. A beach chair comprising:

a generally rectangular open bottom frame formed with a horizontal top run joined at its opposite extremities with oppositely disposed side legs projecting downwardly and defining at their lower extremities respective side stakes;

a first and second strut rotatably connected on one extremity with said top run in spaced apart relationship for rotating thereabout from a collapsed position in the plane of said side legs to support position angled outwardly therefrom and defining on its bottom extremity a strut stake;

web means connected on its opposite ends with said side legs to form a backrest;

a generally tubular headrest cushion telescoped over said top run whereby said strut may be rotated to said support position and said strut stake driven into the beach so a user may rest his back against said web means and his head against said headrest cushion; and rack means including a pair of upwardly opening brackets mounted intermediately on said first and second struts.

7. A beach chair as set forth in claim 6 wherein:

said rack means includes a pair of elastic retaining chords connected on their respective one extremities with said top run and including on their opposite extremities, hooks for engaging said respective brackets.

8. A chair for use on a beach comprising:

a generally rectangular open bottom frame formed with a horizontal top run joined at its opposite extremities with oppositely disposed side legs projecting downwardly and defining at each of their lower extremities respective side stakes;

a strut rotatably connected on one extremity with said top run for rotating thereabout from a collapsed position in the plane of said side legs to support position angled outwardly therefrom and defining on its bottom extremity a strut stake;

webbing connected on its opposite ends with said side legs to form a backrest; and, a pair of shoulder straps connected on their respective one ends with said top run and on their respective opposite ends with the bottom of said webbing.

* * * * *